US010006325B2

(12) United States Patent
Okazaki et al.

(10) Patent No.: US 10,006,325 B2
(45) Date of Patent: Jun. 26, 2018

(54) PCV VALVE

(71) Applicant: NIFCO INC., Yokosuka, Kanagawa (JP)

(72) Inventors: Tsuyoshi Okazaki, Kanagawa (JP); Motoharu Takai, Kanagawa (JP)

(73) Assignee: Nifco Inc., Kanagawa (JP)

( * ) Notice: Subject to any disclaimer, the term of this patent is extended or adjusted under 35 U.S.C. 154(b) by 113 days.

(21) Appl. No.: 15/104,611

(22) PCT Filed: Dec. 5, 2014

(86) PCT No.: PCT/JP2014/006109
§ 371 (c)(1),
(2) Date: Jun. 15, 2016

(87) PCT Pub. No.: WO2015/098005
PCT Pub. Date: Jul. 2, 2015

(65) Prior Publication Data

US 2016/0312671 A1 Oct. 27, 2016

(30) Foreign Application Priority Data

Dec. 25, 2013 (JP) ..... 2013-267298

(51) Int. Cl.
*F01M 13/00* (2006.01)

(52) U.S. Cl.
CPC . *F01M 13/0011* (2013.01); *F01M 2013/0027* (2013.01)

(58) Field of Classification Search
CPC ..... F01M 13/0011; F01M 2013/0027
See application file for complete search history.

(56) References Cited

U.S. PATENT DOCUMENTS 6,044,829 A * 4/2000 Butz ..... F01M 13/023 123/573
6,546,921 B1 * 4/2003 Callahan ..... F01M 13/0011 123/573

(Continued)

FOREIGN PATENT DOCUMENTS

EP 2546482 A1 1/2013
JP S55164762 A 12/1980

(Continued)

OTHER PUBLICATIONS

Extended European Search Report for Application No. 14874494.9, dated Jul. 24, 2017, 7 pages.

(Continued)

*Primary Examiner* — Joseph Dallo
*Assistant Examiner* — Kurt Liethen
(74) *Attorney, Agent, or Firm* — Armstrong Teasdale LLP

(57) ABSTRACT

Provide is a PCV valve which can be quickly defreezed and provides a favorable sealing to the heater against the blow-by gas. The PCV valve (2) comprises a housing (6) defining a flow passage (4) for blow-by gas, a valve member (30) positioned in the flow passage to cooperate with a valve seat (18) formed in the housing, a spring (38) biasing the valve member toward the valve seat, a heat transmission member (40) including a heat dissipating part (42) surrounding the valve member, and a heating unit (52) including a heating element (66) for heating the heat transmission member, the heating element being separated from the flow passage in an air tight manner.

8 Claims, 2 Drawing Sheets

(56) References Cited

U.S. PATENT DOCUMENTS

Figure 1:
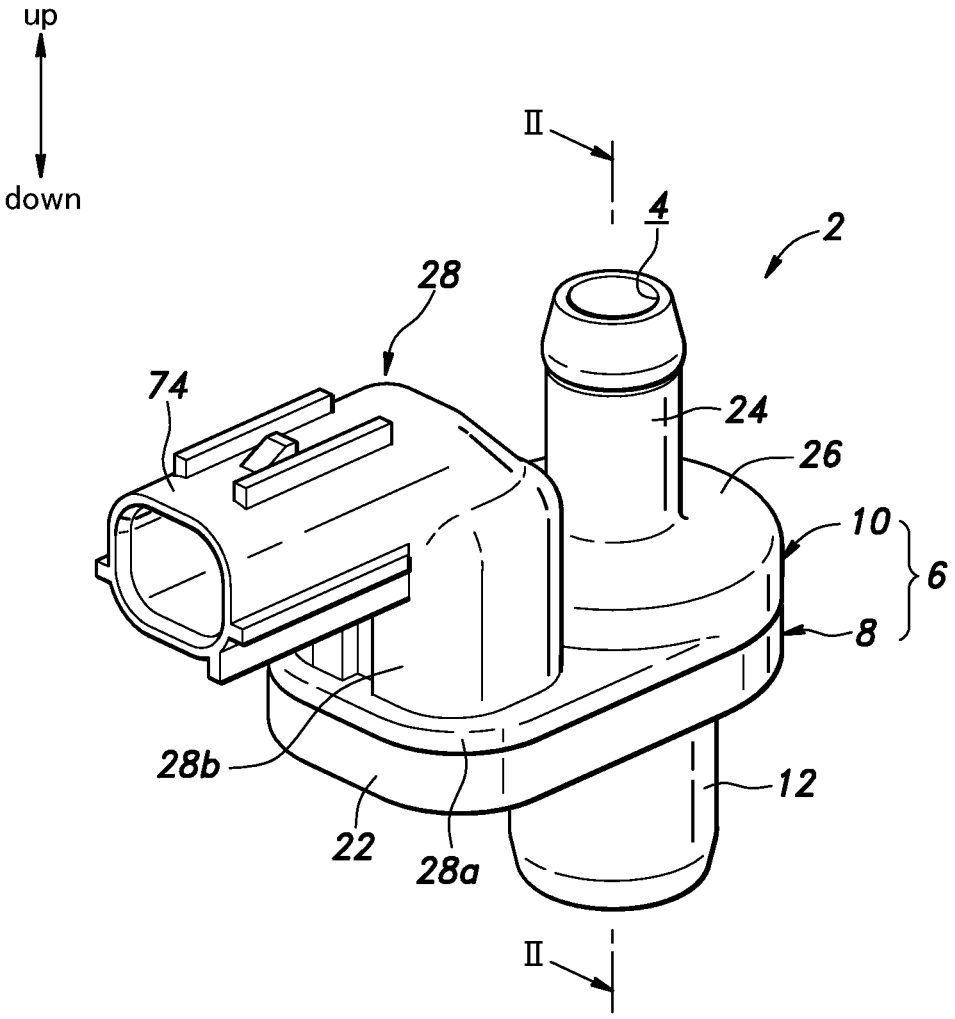

| | | | | |
|---|---|---|---|---|
| 7,263,984 | B2 * | 9/2007 | Wade | F01M 13/0011 123/572 |
| 2008/0099000 | A1 | 5/2008 | Suzuki et al. | |
| 2012/0006306 | A1 * | 1/2012 | Boehm | F01M 13/0011 123/572 |
| 2017/0234178 | A1 * | 8/2017 | Mosher | F01M 13/0011 123/574 |

FOREIGN PATENT DOCUMENTS

| | | | |
|---|---|---|---|
| JP | 60098709 | U1 | 7/1985 |
| JP | 05042620 | U | 6/1993 |
| JP | 2000161040 | A | 6/2000 |
| JP | 2002129928 | A | 5/2002 |
| JP | 2008115734 | A | 5/2008 |
| JP | 2009127543 | A | 6/2009 |
| WO | 03021087 | A1 | 3/2003 |

OTHER PUBLICATIONS

International Search Report for International Application No. PCT/JP2014/006109, dated Mar. 3, 2015, 4 pages.

* cited by examiner

PCV VALVE

TECHNICAL FIELD

The present invention relates to a PCV valve for controlling the flow rate of blow-by gas in a blow-by gas recirculating system of an internal combustion engine.

BACKGROUND ART

The blow-by gas is the gas that leaks out from the combustion chamber of an internal combustion engine of a motor vehicle or the like via the gap between the piston and the cylinder, and contains uncombusted hydrocarbons (HC) and carbon monoxide (CO). As such substances are a cause of pollution of the atmosphere, the PCV (positive crankcase ventilation) system is widely used. In the PCV system, the blow-by gas is returned to the intake system to burn the blow-by gas with the mixture, instead of releasing the blow-by gas to the atmosphere. However, if the amount of the blow-by gas that is returned to the intake system is increased excessively, the performance of the engine may be impaired. Therefore, a PCV valve is commonly used for adjusting the flow rate of the blow-by gas.

A PCV valve may consist of a differential pressure actuated flow rate control valve that adjusts the valve opening according to the pressure difference between the upstream and downstream ends of the valve. When the engine is stationary, as there is no pressure difference, the PCV valve fully closes. If the surrounding temperature is low, the moisture in the intake air may freeze in the PCV valve. In such a case, even when the engine is started and a pressure difference is created between the inlet and outlet ends of the PCV valve, the valve member may be kept fixed so that the PCV valve remains fully closed. Thus, when the flow passage for blow-by gas is blocked owing to the freezing of moisture in the PCV valve, the pressure in the crankcase rises, and this could cause the leakage of oil from the engine, and even seizure of bearings. Therefore, various proposals have been made to prevent the freezing of moisture in the PCV valve.

There are primarily two approaches to prevent freezing in a PCV valve. The first is to use the heat produced from the engine. The second is to use a device specifically designed for heating the PCV valve. Patent Document 1 proposes an arrangement based on the second approach that uses an electric heater for heating the valve member. The electric heater includes a bobbin having an inner surface forming a part of the inner surface of the valve case and a coil wound around the bobbin.

PRIOR ART DOCUMENT(S)

Patent Document(s)

Patent Document 1 JP2008-115734A

SUMMARY OF THE INVENTION

Task to be Accomplished by the Invention

When the PCV valve is to be defreezed by using the heat from the engine, the PCV valve as a whole is required to be made of metallic material. This increases the weight of the PCV valve, and increases the cost because of the need for the machining work of the metallic material. Furthermore, the PCV valve is not warmed until the engine is warmed so that a quicker way to defreeze the PCV valve is desired.

In the case of the PCV valve fitted with an electric heater proposed in Patent Document 1, an adequate sealing is required between the coil that produces the heat and the wiring arrangement for the coil, but may not be achieved in a satisfactory manner. Because the blow-by gas is highly acidic with a pH value of about 2, the coil and the electrodes may be rapidly corroded when brought into contact with the blow-by gas. Titanium coating and other corrosion prevention measure may be taken to prevent such corrosion, but the cost inevitably rises.

The present invention was made in view of such problems of the prior art, and has a primary object to provide a PCV valve which is highly effective in preventing freezing and provides a favorable sealing to the heater against the blow-by gas.

Means for Accomplishing the Task

To achieve such an object, the present invention provides a PCV valve (2), comprising:

a housing (6) defining a flow passage (4) for blow-by gas;

a valve member (30) positioned in the flow passage to cooperate with a valve seat (18) formed in the housing;

a spring (38) biasing the valve member toward the valve seat;

a heat transmission member (40) including a heat dissipating part (42) surrounding the valve member; and a heating unit (52) including a heating element (66) for heating the heat transmission member, the heating element being separated from the flow passage in an air tight manner.

According to this arrangement, because the engine heat is not required to melt the frozen moisture in the PCV valve, the material for the housing and the valve member is not required to be made of metallic material which has a high thermal conductivity but is significantly heavy, but may be made of plastic material which does not have a high thermal conductivity but is lighter and less expensive so that a light-weight PCV valve can be manufactured at low cost. Because the heating unit is separated from the flow passage in an air tight manner, the risk of being corroded by the blow-by gas is eliminated so that no corrosion preventing measure is required, and the manufacturing cost can be reduced.

According to a certain aspect of the present invention, in addition to the above mentioned structure, the housing is provided with a receiving recess (50) opening out toward the flow passage for receiving a heat receiving part (44) forming an end of the heat transmission member, and the heating unit is configured to heat the heat receiving part of the heat transmission member via a partition wall (58) defining at least a part of the receiving recess, a part of the heat dissipating part of the heat transmission member being exposed to the flow passage.

Thereby, the heating unit can be separated from the flow passage in an air tight manner with a highly simple structure.

According to another aspect of the present invention, in addition to the above mentioned structure, the housing includes a first housing (8) defining an upstream side of the flow passage and a second housing (10) defining a downstream side of the flow passage, and the PCV valve further includes an annular member (72) through which the flow passage is passed, the annular member engaging both the first housing and the second housing over an entire circumference to seal an interface between the first housing and the second housing. Alternatively, the interface between the first housing and the second housing may be sealed by welded, instead of using the annular member.

Owing to this arrangement, a highly simple sealing arrangement can be used so that the manufacturing cost can be minimized.

According to yet another aspect of the present invention, in addition to the above mentioned structure, a free end of the heat receiving part of the heat transmission member, the partition wall and the heating element are shaped as plates, and are layered one over another.

Thereby, heat can be transmitted from the heating element to the heat receiving part of the heat transmission member in an efficient manner.

According to yet another aspect of the present invention, in addition to the above mentioned structure, the heating element consists of a PTC heater.

Thereby, the temperature of the heat emitting element can be maintained at a fixed level without using a temperature sensor so that the PCV valve equipped with the heating element can be formed as a compact unit.

According to yet another aspect of the present invention, in addition to the above mentioned structure, the housing further defines a chamber (54) for receiving the heating unit, and the heating unit includes a first electrode (60) interposed between the partition wall and the heating element, an electro-conductive compression coil spring (68) having an end abutting the heating element and a second electrode (62) attached to a wall surface of the chamber opposing the partition wall and abutting another end of the compression coil spring.

Owing to this arrangement, the electro-conductivity and the thermal conductivity of the heating unit can be enhanced, and the mounting of the heating unit in the PCV valve can be facilitated.

According to yet another aspect of the present invention, in addition to the above mentioned structure, the heat transmission member consists of a strip of metallic plate, and the heat dissipating part is formed with a through hole (46) for passing the valve member therethrough.

Owing to this arrangement, the overall structure can be simplified, the PCV valve can be made as a compact unit, and the manufacturing cost can be reduced.

According to the present invention, the PCV valve equipped with a PCV valve can be formed as a compact unit, and the heating unit is protected from being corroded by the blow-by gas.

BRIEF DESCRIPTION OF THE DRAWING(S)

Figure 2:
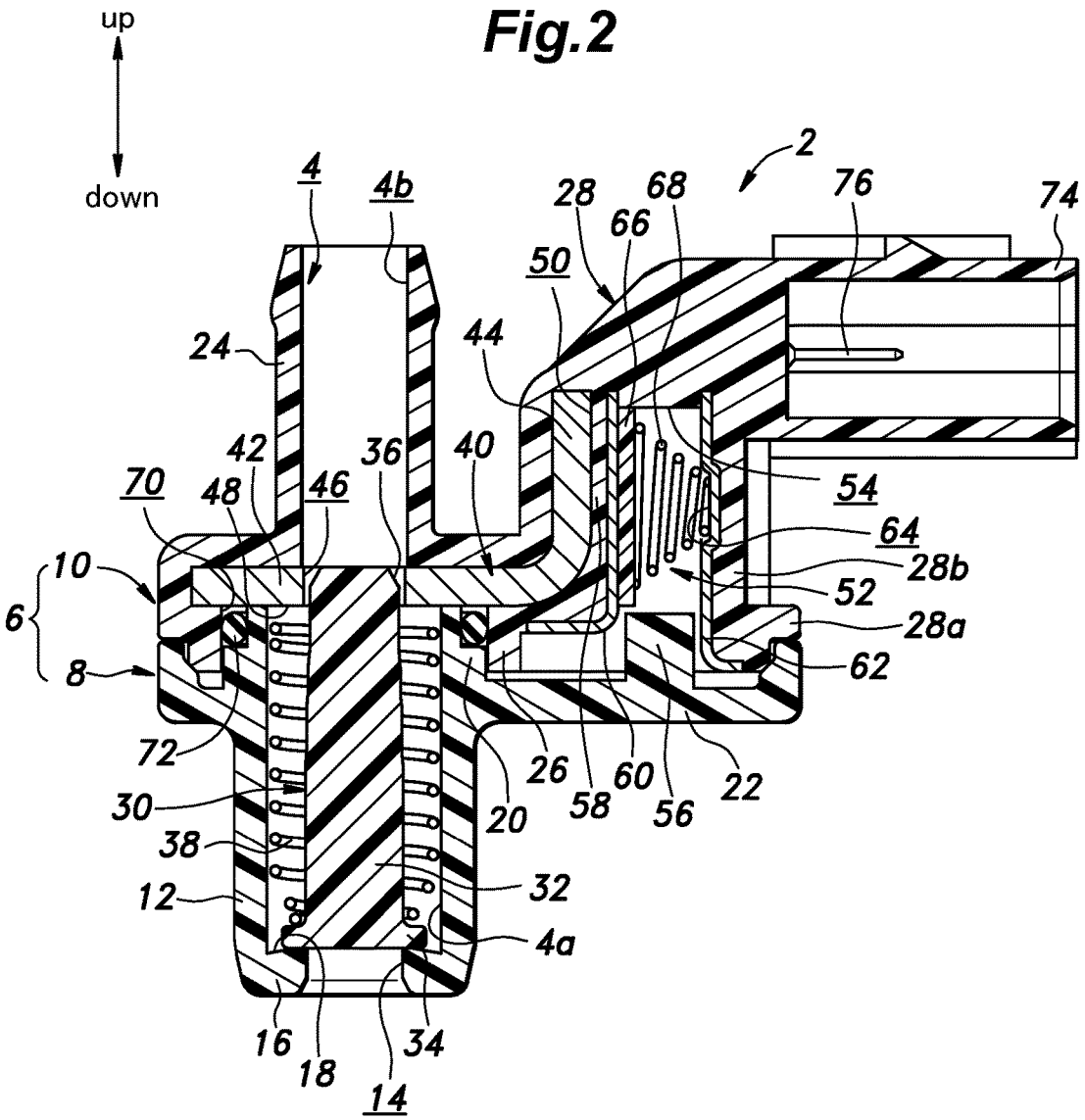

FIG. 1 is a perspective view of a PCV valve embodying the present invention; and FIG. 2 is a vertical sectional view of the PCV valve.

DESCRIPTION OF THE PREFERRED EMBODIMENT(S)

An embodiment of the present invention is described in the following with reference to the appended drawings. The directions mentioned in the disclosure are defined as indicated in the drawings.

FIG. 1 is a perspective view of a PCV valve 2, and FIG. 2 is a sectional view taken along line II-II of FIG. 1. The PCV valve 2 internally defines a flow passage 4 for blow-by gas, and the downstream end (upstream end) of the flow passage 4 is attached to the head cover of a crankcase (not shown in the drawings) while the upstream end (downstream end) of the flow passage 4 is connected to the intake system via a blow-by gas hose (not shown in the drawings) so that the crankcase and the intake system are communicated with each other via the flow passage 4.

The PCV valve 2 is provided with a housing 6 consisting of a first housing 8 defining an upstream flow passage 4*a* and a second housing 10 defining a downstream flow passage 4*b*.

The first housing 8 is made by injection molding plastic material. The first housing 8 includes a first cylindrical part 12 through which the upstream flow passage 4*a* is passed vertically. The lower end of the first cylindrical part 12 is provided with an inlet hole 14 having a reduced inner diameter, and an annular upper shoulder surface of a lower end wall 16 defining the inlet hole 14 serves as a valve seat 18. The part of the first cylindrical part 12 higher than the lower end wall 16 is substantially constant in inner diameter. The first housing 8 is provided with a first bonded part 20 extending outwardly from the upper outer peripheral part thereof so as to define an annular shape in plan view and to be bonded to the second housing 10 and a lid part 22 extending sideways from the entire side of the first bonded part 20 presenting a semicircular shape in plan view. The lower surface of the first bonded part 20 and the lower surface of the lid part 22 are on a same plane.

The second housing 10 is made by injection molding plastic material. The second housing 10 includes a second cylindrical part 24 through which the downstream flow passage 4*b* is passed vertically. The inner diameter of the second cylindrical part 24 is substantially constant, and is smaller than the inner diameter of the first cylindrical part 12. The outer diameter of the second cylindrical part 24 is smaller than that of the first cylindrical part 12. When the first housing 8 and the second housing 10 are combined, the downstream flow passage 4*b* aligns coaxially with the upstream flow passage 4*a*. The outer circumferential surface of the upper end of the second cylindrical part 24 is formed with an annular projection for connecting a hose thereto. The second housing 10 includes a second bonded part 26 extending outwardly from the lower outer peripheral part thereof so as to define an annular shape in plan view and to be bonded to the first bonded part 20 of the first housing 8 and a projecting part 28 extending in the same direction as the lid part 22 from the entire side of the first bonded part 20 presenting a semicircular shape in plan view. The projecting part 28 includes a base portion 28*a* projecting from the semicircular side of the second bonded part 26 in a sideward direction and an L-shaped portion 28*b* extending upward and then laterally from the base portion 28*a* in the shape of letter L. The outer surface of the combination of the first bonded part 20 and the lid part 22, and the outer surface of the combination of the second bonded part 26 and the base portion 28*a* are conformally aligned with each other, and welded to each other. The projecting part 28 will be described in greater detail hereinafter along with the associated component parts.

A valve member 30 is provided in the flow passage 4 of the housing 6 so as to seat on the valve seat 18. The valve member 30 is made of metallic or plastic material, and includes a cylindrical main body 32 and an annular flange 34 formed in the lower end of the main body 32. A cutaway surface 36 is formed between the upper end surface and the circumferential side surface of the main body 32. The main body 32 has a slightly smaller outer diameter in the upper part thereof than in the lower part of the main body 32, and the outer diameter of the main body 32 is generally smaller than the inner diameter or the upstream flow passage 4*a* and the downstream flow passage 4*b* so that the valve member 30 can move freely vertically in the flow passage 4. The outer diameter of the flange 34 is greater than the inner diameter of the inlet hole 14 so that the lower surface of the flange 34 may be seated on the valve seat 18.

A first compression coil spring 38 surrounds the main body 32 of the valve member 30, and the lower end of the first compression coil spring 38 abuts the upper surface of the flange 34.

A heat transmission member 40 configured to transmit heat to the valve member 30 is positioned in the housing 6 such that a one end part thereof is interposed between the first housing 8 and the second housing 10. The heat transmission member 40 is formed by bending a strip of plate by about a 90 degree angle, and is positioned such that a heat dissipating part 42 formed on the one end part and interposed between the first housing 8 and the second housing 10 is perpendicular to the vertical direction. A heat receiving part 44 formed on the other end part of the heat transmission member 40 is bent upward so as to be in parallel with the vertical direction. The heat transmission member 40 may be made of material having a high thermal conductivity, such as metal and ceramic, and the material may be corrosion resistance or processed to be corrosion resistance so as not to be corroded by the blow-by gas.

The heat dissipating part 42 is provided with a vertically extending through hole 46 in a coaxial relationship to the flow passage 4 so that the upstream flow passage 4*a* and the downstream flow passage 4*b* communicate with each other. The inner diameter of the through hole 46 is smaller than the inner diameter of the first cylindrical part 12, and is substantially equal to the inner diameter of the second cylindrical part 24. Therefore, the inner circumferential surface of the through hole 46 and the lower surface of a peripheral part 48 of the through hole 46 are exposed to the flow passage 4. When the valve member 30 is seated on the valve seat 18, the upper end of the first compression coil spring 38 is slightly spaced from the peripheral part 48, but once the opening degree of the PCV valve 2 exceeds a prescribed level, the upper end of the first compression coil spring 38 comes into contact with the peripheral part 48 so that the first compression coil spring 38 urges the valve member 30 against the valve seat 18. Alternatively, when the valve member 30 is seated on the valve seat 18, the upper end of the first compression coil spring is in contact with the peripheral part 48 so that the first compression coil spring 38 urges the valve member 30 against the valve seat 18 at all times. The through hole 46 receives the valve member 30, and the upper surface of the heat dissipating part 42 and the upper end of the valve member 30 may be substantially at a same height when the valve member 30 is seated on the valve seat 18. The vertical dimension of the cutaway surface 36 of the valve member 30 is smaller than the vertical thickness of the heat dissipating part 42. Because the outer diameter of the main body 32 of the valve member 30 is slightly smaller than the inner diameter of the through hole 46, the gap between the valve member 30 and the inner circumferential surface of the through hole 46 is extremely small.

Because the heat transmission member 40 is attached to the second housing 10 by means of insert molding so that a receiving recess 50 is formed in the region ranging from the second bonded part 26 to the projecting part 28 for embedding the heat receiving part 44 therein. Therefore, the receiving recess 50 consists of a recess having a closed bottom and an open upper end facing the flow passage 4. The outer periphery of the heat dissipating part 42 of the heat transmission member 40 is attached to and embedded in the second housing 10. Furthermore, the entire upper surface of the heat dissipating part 42 abuts the second housing 10 such that the inner circumferential surface of the through hole 46 and the inner circumferential surface of the second cylindrical part 24 are smoothly connected to each other, and the lower surface of the heat dissipating part 42 adjoining the through hole 46 is not in contact with the second housing 10.

A heating unit 52 for heating the heat receiving part 44 is provided in a part of the second housing 10 more outwardly than the heat receiving part 44 with respect to the flow passage 4. The projecting part 28 of the second housing 10 is provided with a chamber 54 opening out in the lower part thereof, and the heating unit 52 is placed in this chamber 54. The lower opening of the chamber 54 is closed by the lid part 22 of the first housing 8. The peripheral part of the lower opening of the chamber 54 is in contact with the peripheral part of the lid part 22, and is ultrasonically welded to the lid part 22 in the contact area. The lid part 22 is provided with a projection 56 that projects into the chamber 54 to prevent the heating unit 52 from dropping down. The heating unit 52 heats the heat receiving part 44 via a partition wall 58 separating the receiving recess 50 and the chamber 54 from each other. The partition wall 58 is desired to be as thin as possible. Because the partition wall 58 is not a part of the outer wall, reducing the thickness of the partition wall 58 does not substantially affect the mechanical strength of the PCV valve 2.

The heating unit 52 includes a first electrode 60 attached to the chamber 54 side of the partition wall 58. The first electrode 60 is made of a strip of thin sheet metal which is bent by a 90 degree angle in sectional view so as conform to the shape of the heat receiving part 44 of the heat transmission member 40, and is brought into close contact with the partition wall 58. Therefore, the upper side of the first electrode 60 consists of a vertically extending plate, and the lower part consists of a plate extending perpendicularly to the vertical direction. A second electrode 62 is attached to the wall surface of the chamber 54 opposite to the surface on which the upper part of the first electrode 60 is attached. The second electrode 62 consists of a plate member made of metallic material. The second electrode 62 is centrally provided with a recess 64 recessed away from the first electrode 60. The first electrode 60 and the second electrode 62 are attached to the second housing by insert molding.

A heating element 66 and a second compression coil spring 68 are interposed between the first electrode 60 and the second electrode 62. The heating element 66 is provided with a plate shape having a major surface area substantially corresponding to the plate-shaped upper part of the first electrode 60, and one of the major surfaces conformally contacts and is electrically connected to the upper part of the first electrode 60. The second compression coil spring 68 is electro-conductive, and abuts the recess 64 of the second electrode 62 at an end thereof and the other major surface of the heating element 66 at the other end thereof. Therefore, the second compression coil spring 68 not only electrically connects the second electrode 62 with the heating element 66 but also urges the heating element 66 against the first electrode 60, thereby preventing the heating element 66 from being dislodged. The heating element 66 is configured to generate heat when electric current is supplied thereto, and preferably consists of a PTC heater. A PTC heater is provided with a PTC (positive temperature coefficient) property so that the current flowing the heater decreases with an increase in the temperature when a constant voltage is applied to the heater. Therefore, in a PTC heater, because the electric current flowing through the heater decreases with an increase in the temperature when a constant voltage is applied thereto, the amount of heat generation decreases with an increase in the temperature so that the heater is able to operate in a stable manner at a prescribed temperature. If no such heater is used as the heating element 66, it is desirable to use a temperature sensor and a switch that turns on and off depending on the temperature detected by the temperature sensor.

Because of the use of the structure where the heating element 66 is pressed against the first electrode 60 by the second compression coil spring 68, the electro-conductivity and the thermal conductivity between the heating element 66 and the first electrode 60 can be favorably maintained. Owing to the provision of the chamber 54, the heating unit 52 can be made highly compact, and the assembling of the heating element 66 and the second compression coil spring 68 is simplified. Because the first electrode 60 may be made of metallic plate which has a high thermal conductivity and is easier to work than the heating element 66 consisting of a PTC heater, the first electrode 60 may be worked into a shape and positioned so as to cover the chamber side surface of the partition wall 58 and allow the heat generated by the heating element 66 to be transmitted to the heat transmission member 40 in an efficient manner.

By combining the first bonded part 20 of the first housing 8 and the second bonded part 26 of the second housing 10, an annular circumferential groove 70 having an open top side surrounding the flow passage 4 is created. The free end of the partition wall 58 forms a part of this circumferential groove 70 on the side of the second housing 10. An O ring 72 is fitted into the circumferential groove 70 as a seal member, and the upper open side of the circumferential groove 70 is closed by the heat transmission member 40. In other words, as shown in FIG. 2, the heat transmission member 40 is surrounded by the first bonded part 20 of the first housing 8, the receiving recess 50 of the second housing 10 and the second bonded part 26 of the second housing 10 except for the part of the heat transmission member 40 exposed to the flow passage 4, and the interface between the first bonded part 20 and the second bonded part 26 is sealed by the O ring 72. Therefore, the blow-by gas that flows through the flow passage 4 does not leak out of the PCV valve 2 or leak into the chamber 54. In other words, because the flow passage 4 and the chamber 54 are separated from each other in an air tight manner, even though a part of the heat transmission member 40 is exposed to the flow passage 4, the heating unit 52 received in the chamber 54 does not contact the blow-by gas. Instead of using the O ring 72, the first bonded part 20 and the second bonded part 26 may be welded to each other around the entire circumference of the flow passage 4 so that a required sealing may be achieved.

The free end of the L shaped part 28*b* of the projecting part 28 of the second housing 10 is provided with a socket 74 for electrically connecting the heating unit 52 with an external electric power source. The socket 74 opens out to the side facing away from the flow passage 4. A pair of terminals 76 fitted in the socket 74 are electrically connected to the first electrode 60 and the second electrode 62, respectively, and attached to the second housing 10 by injection molding.

The mode of operation and the advantages of the PCV valve 2 are discussed in the following.

When the engine is not in operation, as there is no pressure difference between the crankcase on the upstream end and the intake system on the downstream end, the valve member 30 is seated on the valve seat 18 under the gravitational force. When the temperature is low, the moisture that may be deposited on the inner circumferential surface of the housing 6 defining the flow passage 4 and the valve member 30 may freeze. The frozen moisture may prevent the vertical movement of the valve member 30. In the PCV valve 2 of the illustrated embodiment, when the heating unit 52 receives electric power, the heating element 66 generates heat, and the generated heat is transmitted to the partition wall 58, the heat receiving part 44 of the heat transmission member 40 and the heat dissipating part 42 of the heat transmission member 40, in that order. As a result, the heat transmitted from the heat dissipating part 42 melts the frozen moisture that may be deposited between the valve member 30 and the heat transmission member 40 so that the valve member 30 becomes moveable. The moisture that has frozen on the side surface of the valve member 30 melts as the valve member 30 contacts or comes close to the heat dissipating part 42 as the valve member 30 is lifted so that the vertical movement of the valve member 30 is not impeded. The heat of the heat dissipating part 42 is transmitted to the valve member 30 itself, the first cylindrical part 12, the second cylindrical part 24 and the air in the flow passage 4. After the upper end of the first compression coil spring 38 has contacted the heat transmission member 40, the heat of the heat dissipating part 42 is transmitted also to the first compression coil spring 38. Thereby, the frozen moisture deposited on the lower side of the valve member 30, the inner circumferential surfaces of the first cylindrical part 12 and the second cylindrical part 24 can be melted in a favorable manner.

When electric power is supplied to the heating unit 52 in response to the powering up of the accessories of the vehicle or the starting of the engine, the frozen moisture in the PCV valve 2 can be quickly melted. If electric power is supplied to the heating unit 52 at all times or depending on the surrounding temperature, the freezing of the PCV valve can be prevented.

When the freezing of the moisture in the PCV valve 2 is prevented as discussed above, as soon as a pressure difference is created between the crankcase and the intake system, and the lifting force due to the pressure difference becomes greater than the weight of the valve member 30, the valve member 30 is lifted away from the valve seat 18 thereby opening the PCV valve 2, and the upper end of the valve member 30 advances into the second cylindrical part 24. As a result, the blow-by gas is allowed to flow along the valve member 30, the first cylindrical part 12, the heat transmission member 40 and the second cylindrical part 24, and is then supplied to the intake system.

The blow-by gas and the moisture that is contained in the blow-by gas may infiltrate into the interfaces between the first housing 8, the heat transmission member 40 and the second housing 10. However, the interfaces are communicated only with the flow passage 4 and the circumferential groove 70 having the O ring 72 received therein. Therefore, the blow-by gas and the moisture that is contained in the blow-by gas eventually return to the flow passage 4, and are drawn into the intake system. The blow-by gas and the moisture that is contained in the blow-by gas that have reached the circumferential groove 70 is prevented from reaching the part of the interface between the first housing 8 and the second housing 10 located below the circumferential groove 70 because the O ring 72 provides a sealing between the first bonded part 20 and the second bonded part 26. Therefore, the heating unit 52 positioned in the chamber 54 is sealed from the flow passage 4 in an air tight manner, and is therefore prevented from being exposed to the blow-by gas or the moisture containing the blow-by gas content. Therefore, no particular corrosion preventive measure is require to be applied to the heating unit 52 so that the manufacturing cost can be reduced.

Because the PCV valve 2 is provided with the heating unit 52, the valve is not required to be made of metallic material as is the case with the PCV valve using the heat of the engine for defreezing purpose. Therefore, the housing 6 and the valve member 30 may be made of plastic material so that the weight of the PCV valve 2 is minimized.

The heat transmission member 40 is a plate member, and the heat receiving part 44 is bent upward from the heat dissipating part 42 by an angle of about 90 degrees. Therefore, the most part of the chamber 54 and the socket 74 may be accommodated in the projecting part 28 having the shape of letter L. Therefore, the shape of the PCV valve 2 can be designed such that the mounting of the PCV valve 2 to the head cover is facilitated, and the connection of the wire leading to the external electric power source is also facilitated.

The present invention has been described in terms of a specific embodiment, but is not limited by such an embodiment, and can be modified in various ways without departing from the spirit of the present invention. For instance, the heat transmission member may consist of a straight plate, instead of a bent plate. The housing may be formed as a single body, instead of two parts that are joined to each other, and the heat transmission member for the flow passage which is insert molded with the housing and exposed to the flow passage may be heated by a heating unit provided externally of the housing.

GLOSSARY OF TERMS

| | | | |
|---|---|---|---|
| 2 | PCV valve | 4 | flow passage |
| 6 | housing | 8 | first housing |
| 10 | second housing | 12 | first cylindrical part |
| 14 | inlet hole | 18 | valve seat |
| 24 | second cylindrical part | 28 | projecting part |
| 30 | valve member | 32 | main body |
| 34 | flange | 38 | first compression coil spring |
| 40 | heat transmission member | 42 | heat dissipating part |
| 44 | heat receiving part | 46 | through hole |
| 50 | receiving recess | 52 | heater |
| 54 | chamber | 58 | partition wall |
| 60 | first electrode | 62 | second electrode |
| 66 | heating element | 68 | second compression coil spring |
| 70 | circumferential groove | 72 | O ring |
| 74 | socket | | |

The invention claimed is:

1. A positive crankcase ventilation (PCV) valve, comprising:

a housing defining a flow passage for blow-by gas;

a valve member positioned in the flow passage to cooperate with a valve seat formed in the housing;

a spring biasing the valve member toward the valve seat;

a heat transmission member including a heat dissipating part surrounding the valve member; and a heating unit including a heating element for heating the heat transmission member, the heating element being separated from the flow passage in an air tight manner, wherein the housing is provided with a receiving recess opening out toward the flow passage for receiving a heat receiving part forming an end of the heat transmission member, and the heating unit is configured to heat the heat receiving part of the heat transmission member via a partition wall defining at least a part of the receiving recess, a part of the heat dissipating part of the heat transmission member being exposed to the flow passage.

2. The PCV valve according to claim 1, wherein the housing includes a first housing defining an upstream side of the flow passage and a second housing defining a downstream side of the flow passage, and the PCV valve further includes an annular member through which the flow passage is passed, the annular member engaging both the first housing and the second housing over an entire circumference to seal an interface between the first housing and the second housing.

3. The PCV valve according to claim 1, wherein the housing includes a first housing made of plastic material and defining an upstream side of the flow passage and a second housing made of plastic material and defining a downstream side of the flow passage, an interface between the first housing and the second housing surrounding the flow passage being sealed by welding.

4. The PCV valve according to claim 1, wherein a free end of the heat receiving part of the heat transmission member, the partition wall and the heating element are shaped as plates, and are layered one over another.

5. The PCV valve according to claim 1, wherein the heating element consists of a heater having a positive temperature coefficient (PTC) property.

6. The PCV valve according to claim 1, wherein the housing further defines a chamber for receiving the heating unit, and the heating unit includes a first electrode interposed between the partition wall and the heating element, an electro-conductive compression coil spring having an end abutting the heating element and a second electrode attached to a wall surface of the chamber opposing the partition wall and abutting another end of the compression coil spring.

7. The PCV valve according to claim 1, wherein the heat transmission member consists of a strip of metallic plate, and the heat dissipating part is formed with a through hole for passing the valve member therethrough.

8. The PCV valve according to claim 2, wherein the heat transmission member consists of a strip of metallic plate, and the heat dissipating part is formed with a through hole for passing the valve member therethrough.

* * * * *